US005857490A

United States Patent [19]

Kao

[11] Patent Number: 5,857,490

[45] Date of Patent: Jan. 12, 1999

[54] STRUCTURE OF A PUMP VALVE FOR CONCRETE MIXTURE PUMPING TRUCKS

[76] Inventor: Chin-Yen Kao, 17, Ho Chun N. Rd., Chung-Li Industrial Zone Taoyuan, Taiwan

[21] Appl. No.: 848,278

[22] Filed: Apr. 29, 1997

[51] Int. Cl.[6] ..... F04B 15/02

[52] U.S. Cl. ..... 137/625.45; 137/874; 417/532

[58] Field of Search ..... 137/874, 625.45; 417/532, 900

[56] References Cited

U.S. PATENT DOCUMENTS

| | | | |
|---|---|---|---|
| 3,132,669 | 5/1964 | Feldsted | 137/874 X |
| 4,296,676 | 10/1981 | Andrews et al. | 137/625.45 X |
| 4,382,752 | 5/1983 | Schlect | 417/532 X |
| 4,613,290 | 9/1986 | Evenson | 417/532 X |
| 4,653,990 | 3/1987 | Schlecht | 137/625.45 X |
| 4,979,884 | 12/1990 | Letarte | 137/874 X |

*Primary Examiner*—John Fox
*Attorney, Agent, or Firm*—Bacon & Thomas, PLLC

[57] ABSTRACT

A pump valve assembly includes a pair of pistons containing cylinder bores opening to a front wall for conveying a concrete mixture from a feed chamber to a delivery tube. A pivotal S-bend tube establishes fluid communication between two valve body wear rings and the delivery tube to cause a translational movement of the input port to the valve assembly between two operative positions in which the input port is in register with the wear rings, the S-bend tube also being engaged with a wear ring. During use, compression of the valve assembly against a positive displacement pump is achieved solely at the front wall of the assembly, with the delivery tube at the rear wall providing only alignment and support, thereby enabling rapid disassembly and access to the valve body and S-bend wear rings.

2 Claims, 4 Drawing Sheets

STRUCTURE OF A PUMP VALVE FOR CONCRETE MIXTURE PUMPING TRUCKS

BACKGROUND OF THE INVENTION

The invention here is a kind of improved structure pump valve for concrete mixture pumping trucks, and in particular a kind that has a pump valve structure that is easily replaced and long lasting.

With the gradual development of modern engineering, as construction involves excessive height, length, area, distance and sheer scale area, special tools are overcoming the difficulties of building. In this kind of construction, it is difficult to avoid the use of various pumps to build contiguous walls, ground foundations or skirts and bridge columns and so on. Human labor is incapable of meeting the requirements of this type of construction and has been replaced by a kind of concrete pumping truck, which is a specialized truck having a kind of flexible pipe and a rear hopper, wherein a pump conveys the concrete mixture at high pressure through piping, and then delivers it from the rear end of the piping to the desired construction site, the piping being similar to a fire fighting ladder truck in that it can be lengthened to higher, deeper or farther areas for effortlessly conveyance of the concrete mixture rapidly to each area. In the present age of labor shortages and inflated labor wages, this equipment is not only a kind that saves human labor and lowers cost but, furthermore, shortens construction periods and raises economic efficiency.

This kind of concrete pumping truck, whose building principles are indicated in FIG. 1 and FIG. 2, makes use of the pump delivery valve structure of currently utilized concrete pumping trucks, which after the concrete mixture is conveyed from the hopper (H), and extracted from two pistons (P) and the S-bend pipe (S) of a exchanger valve, conveys the concrete mixture out at high pressure through the piping (A). The S-bend pipe (S) uses a crank tip (R) at one end that is subjected to a gas cylinder (C) at the lower end to produce the movement of the operation which, when conjoined to the surface of the S-bend pipe (S) is capable of conveying the concrete mixture. The other opening momentarily suctions in the concrete mixture such that when the S-bend pipe (S) once again moves to the opening that just suctioned in the concrete mixture, the piston (P) then conveys the concrete mixture out. As a result, the concrete mixture passing through this kind of S-bend pipe (S) can be conveyed out at high pressure from the valve cut-off of the valve (V). An alternative kind of pump structure, as indicated in FIG. 3 and FIG. 4, consists of a sliding rod (d) attached at the top to a shut-off plate (d1) and, furthermore, utilizes the aforesaid sliding rod (d) for insertion into the two valves (V), utilizing the oil pressure cylinders (O) at the front and the rear end of the sliding rod (d) to produce reciprocation that causes the shut-off plate (d1) to move back and forth between the two valves (V) and remain aligned with the reciprocal motion of the two pistons (P) to achieve the conveying of the concrete mixture at high pressure out through the pipe (A). Since the pump valve structure is the heart of the main power resource of the concrete pumping truck pump that conveys the concrete mixture to the work site main force, the overall capability of the concrete pumping truck to convey the concrete mixture is involved and, therefore, no matter whether use is made of the aforesaid S-bend shut-off pump valve or, as indicated in FIG. 3 and FIG. 4, the flat cut plate-type shut-off valve structure, the shut-off component (the S-bend pipe or the sliding rod), must have a very rapid reciprocating speed and, furthermore, must have a high degree of friction-resistance and impact resistance. The problem is that, as acknowledged, for a majority of metal materials, friction-resistance and impact-resistance normally exist in inverse proportions. Thus, in the case of pump valves, while the aforementioned conventional S-shaped pipe shut-off valve structure has a usable frictional wear service life of 12,000 cubic meters to 15,000 cubic meters., which is longer than the frictional wear service life of flat cut plate-type pump valves, fabrication of the valves is difficult in that the friction-resistance is not fully ideal and the valve cannot be adjusted after frictional wear occurs due to the clearances between the S-bend pipe and the other two components, and the price of fabrication is high, among other related shortcomings. On the other hand, in the case of the flat cut plate-type pump valve structure, mostly due to its structural shape, in actual utilization tests, after high speed sliding shut-off friction and concrete mixture impacts of between approximately 8,000 cubic meters has occurred to 12,000 meters, not only do extremely large clearances (F) occur in between the two valves (V) and cut-off valve (d1), but also between the linkage of the sliding rod (d) and the sleeve of the valve (V), which produces fissures (f). In both cases, disassembly and reassembly is difficult, as indicated in FIG. 5, and therefore, pump valves that are not friction-resistant and that cannot be adjusted after frictional wear and other related shortcomings are rarely observed in present-day pumping trucks. Since the pump valve is not friction-resistant, excessively large clearances are produced between the valves and the shut-off components resulting in the phenomenon that, when the pump is conveying concrete mixture, the concrete mixture and the water content leaks through the aforesaid clearances and gives rise to hardening of concrete mixture, obstructing the concrete mixture delivery process. Since, when the concrete mixture is being conveyed, the concrete mixture and water content must be first stirred, if the water content and the concrete mixture leaks through the aforesaid clearances, the insufficient concrete mixture delivery pressure affects the high pressure value and high water level high pressure concrete mixture delivery which leads, as a result, to also causing the concrete mixture to harden and clog the piping and finally, the pump valves must be frequently replaced, leading not only to increases in component costs but, furthermore, to the expenditure of time and effort for the installation process, thereby extending the construction period. In view of this, the inventor of the invention herein has improved the structure of the conventional pump valve, utilizing a modular design and a simple component assembly resulting in a simplified pump valve structure, enabling the friction-resistance to meet actual requirements, which not only lowers manufacturing costs and significantly increases its usable frictional resistance, but also increases its usable service life and, furthermore, in terms of the simplified structure, is capable of achieving simple disassembly, easy fabrication. In addition, the S-bend pipe of the invention herein has an adjustment screw with fine adjustment capability, which significantly increases the usable service life and constitutes a major objective of the invention herein.

To achieve the aforementioned objectives, the technological means and functions utilized by the invention herein is presented as accompanied by the brief description of the drawings followed by the detailed description, to thereby enable a further understanding of the structure, innovative characteristics and functions of the invention herein.

DETAILED DESCRIPTION OF THE INVENTION

Figure 1:
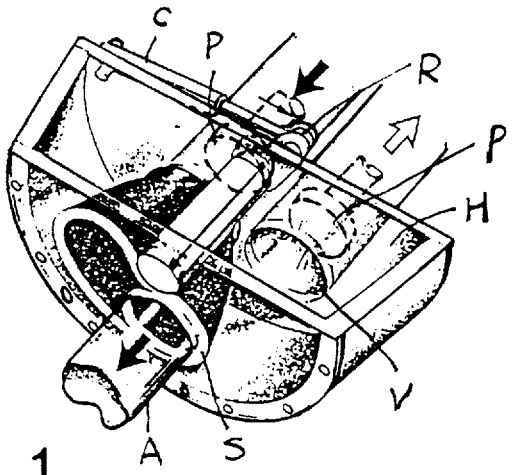
FIG. 1 and FIG. 2 are isometric drawings of conventional S-bend cut-off type pump valve.
Figure 2:
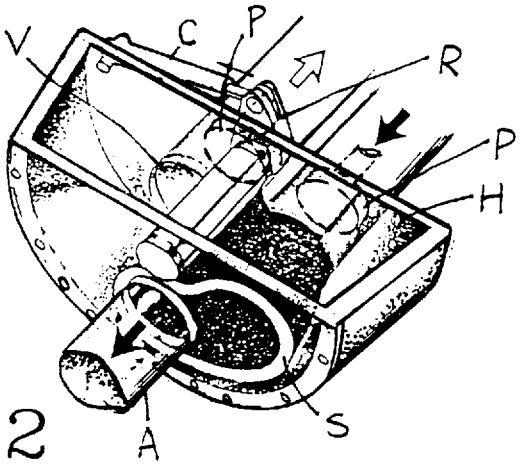
Figure 3:
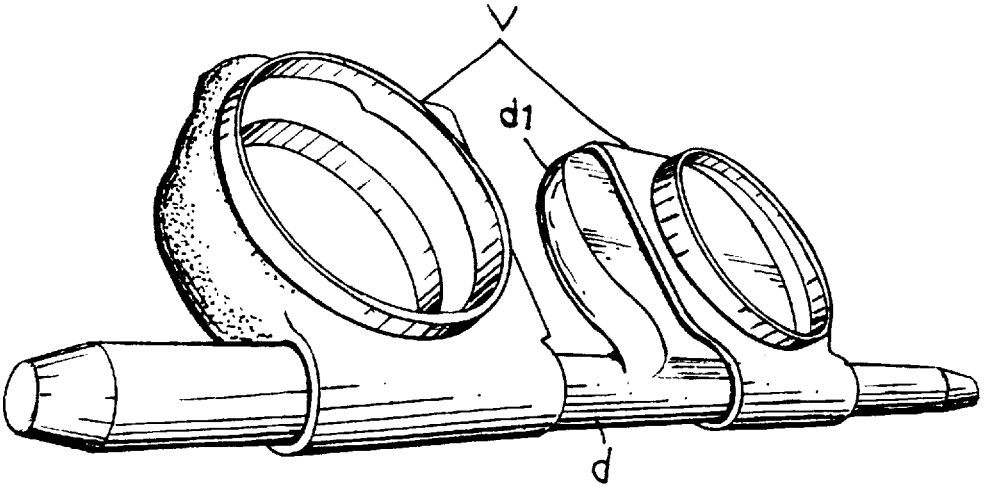
FIG. 3 is an isometric drawing of conventional flat cut plate-type pump valve.
Figure 4:
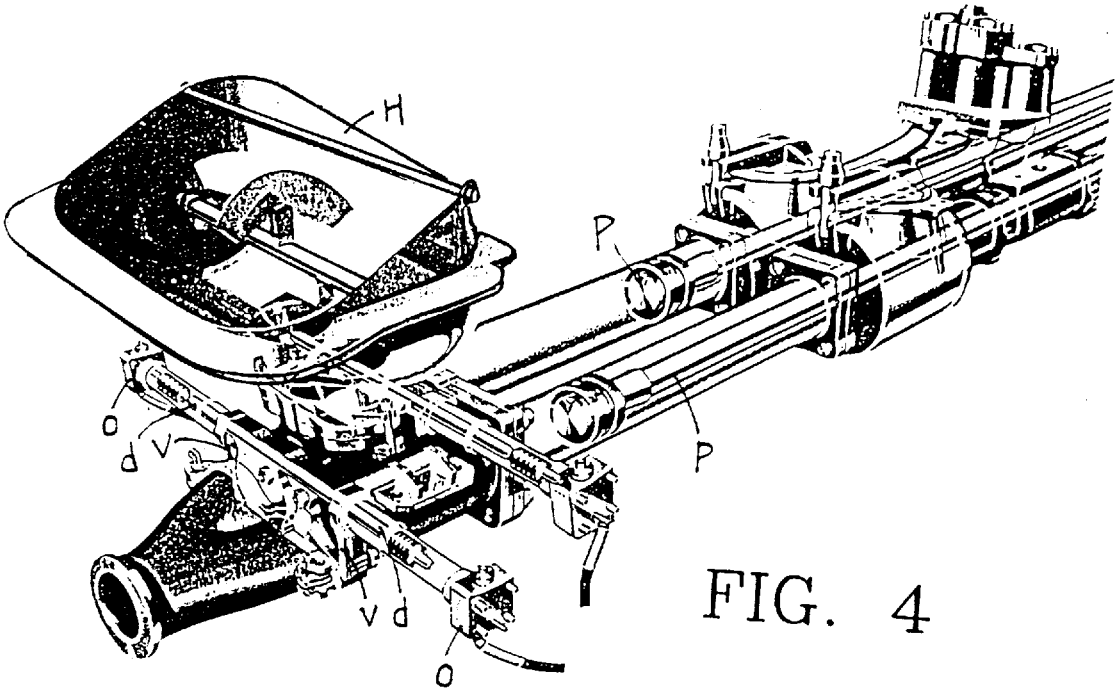
FIG. 4 is an isometric drawing of a conventional flat cut plate-type pump valve depicted in a state of application.
Figure 5:
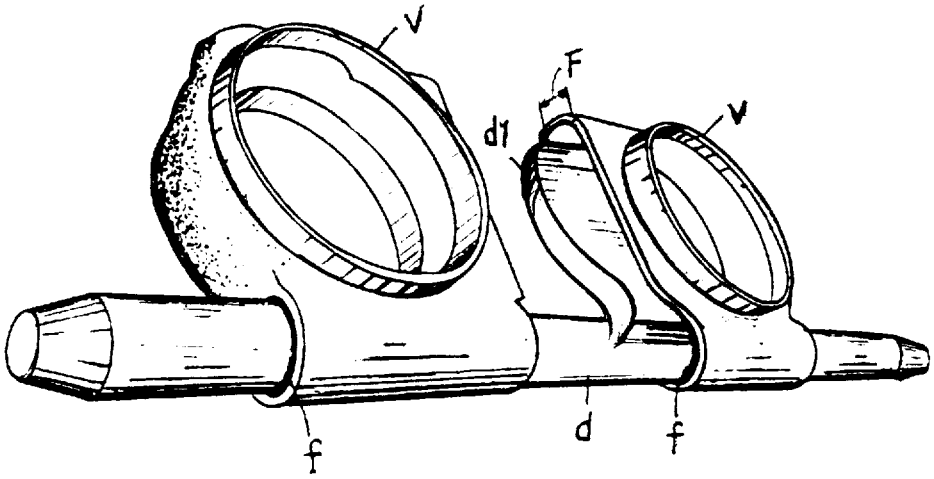
FIG. 5 is an isometric drawing of a conventional flat cut plate-type pump valve illustrating the frictional wear produced by 12,000 cubic meters.
Figure 6:
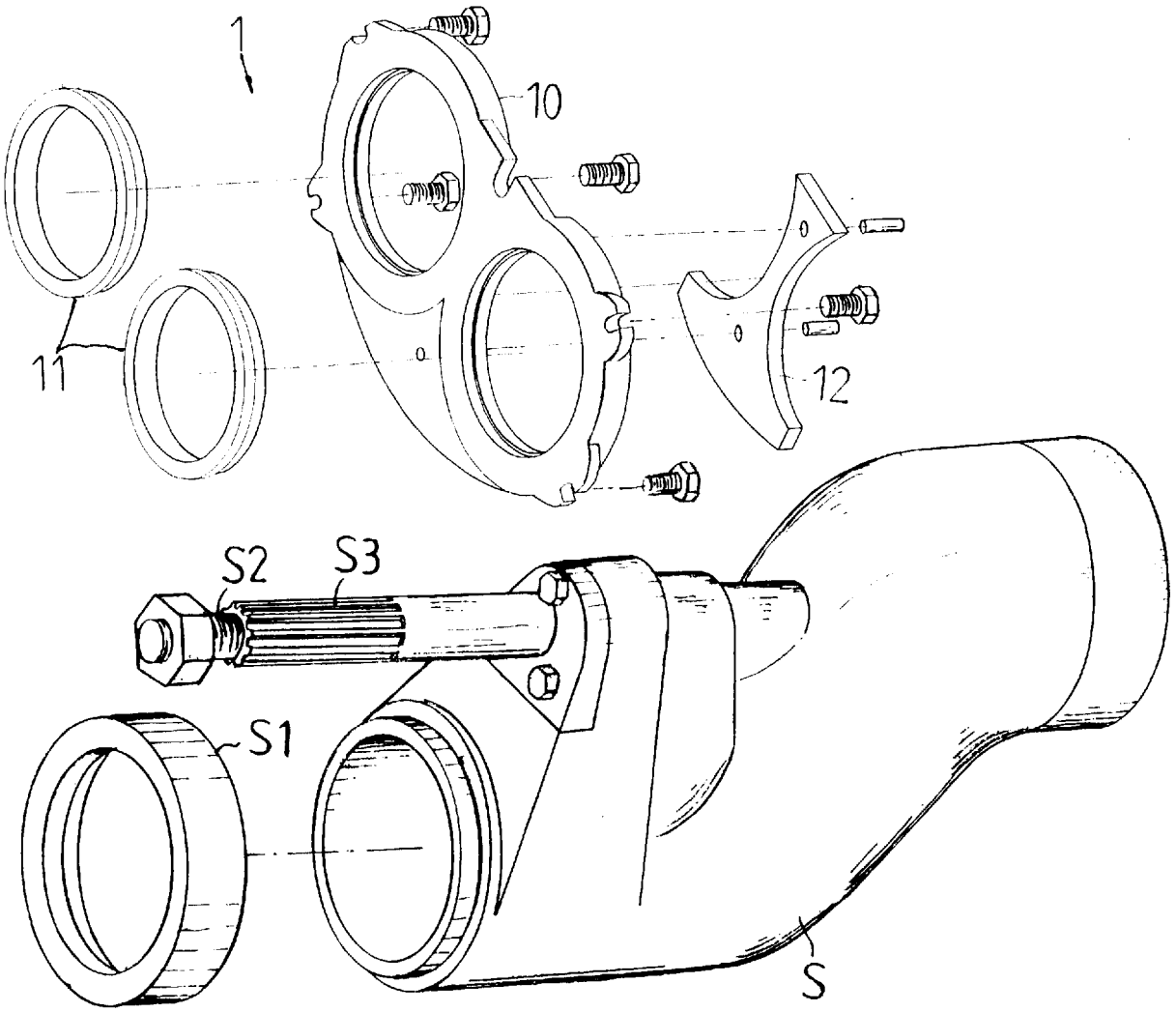
FIG. 6 is an isometric exploded drawing of the invention herein.
Figure 7:
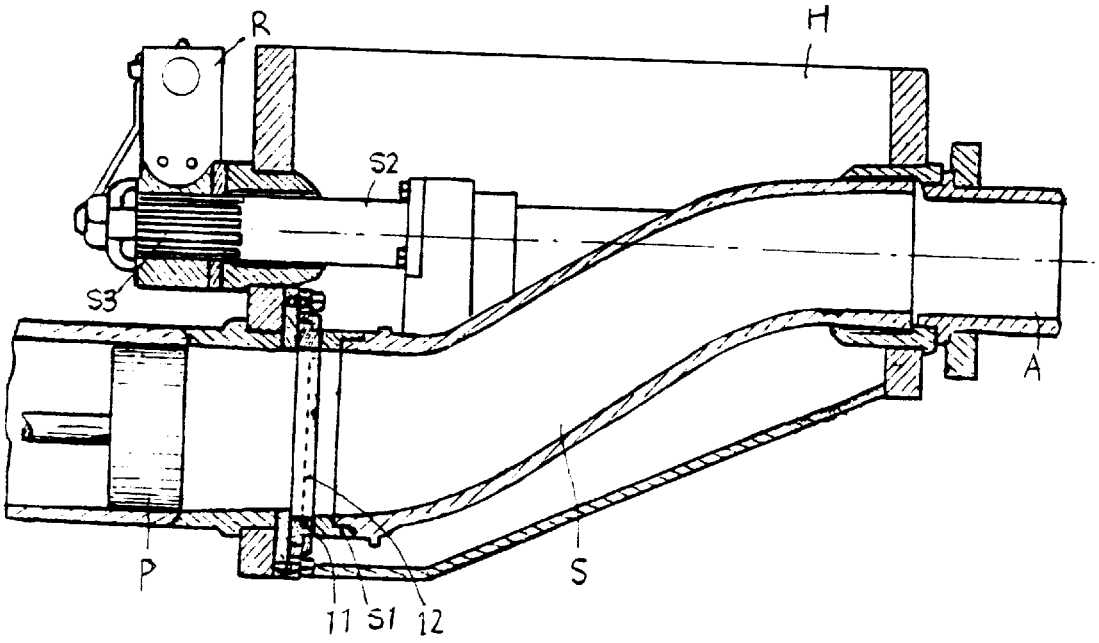
FIG. 7 is cross-sectional assembly drawing of the invention herein.
Figure 8:
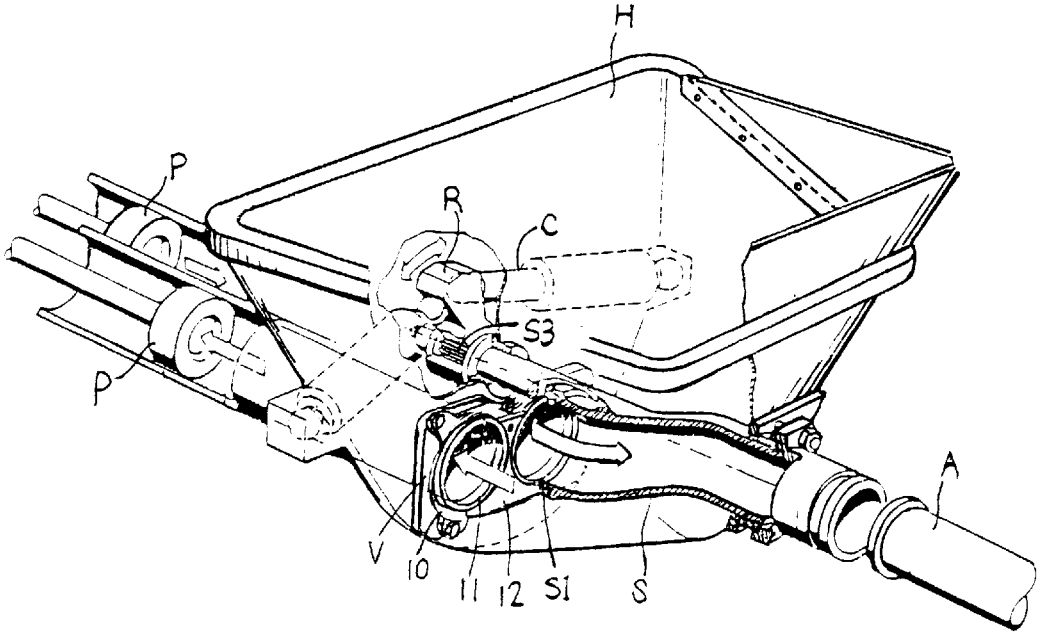
FIG. 8 is an application embodiment of the invention herein.

As indicated in FIG. 6 and FIG. 7, the invention includes a valve assembly (1) and an S-bend tube (S); the valve assembly (1) including a valve body (10) housing two tungsten steel rings (11) that are secured by a front connecting tungsten steel piece (12), and the S-bend pipe (S) utilizing the top end for conjoinment via a tungsten steel ring (S1). Over the top end is threaded rod (S2) and on the threaded rod (S2) are axially oriented splines (S3). The center of the aforesaid threaded rod (S2) is aligned with the center line of the other end of the S-bend tube (S). During utilization, it is only necessary to utilize a number of bolts to fasten the valve body (10) to the upper ends of the two pistons (P) to form a single entity that is inseparable, and the S-bend pipe (S) then utilizes the axially oriented splines (S3) on the upper end of the threaded rod (S2) for fastening to the crank tip (R), the other end being linked to the junction shaft bearing inside he delivery pipe (A), thereby enabling the securing of the tungsten steel ring (S1) flush onto the tungsten steel ring (11) of the valve body (10). Consequently, as indicated in FIG. 8, when the two pistons (P) reciprocate and both the left and the right cylinders likewise reciprocate left and right, the S-bend pipe (S) is moved leftward and rightward, and as concrete mixture inside the hopper (H) is suctioned by the piston (P) and the other piston (P) has already contacted both of the two sets of tungsten steel rings (the tungsten steel rings on the pump body and the tungsten steel rings on the S-bend pipe), the concrete mixture inside is conveyed out of the pipe (A) at high pressure. In such a repetitious operation the concrete mixture is continuously and, furthermore, rapidly conveyed outward, since the surfaces exposed to friction are highly friction-resistant tungsten steel rings and tungsten steel pieces. Therefore, the friction-resistance is significantly increased to minimize the rate of friction at the delivery valve (based on current testing results, following 5,000,000 cubic meters, the degree of frictional wear was approximately 0.05 mm; in other words, there was 50 times the frictional wear on the flat cut plate-type pump valve which was approximately 35 times that of the conventional S-bend pipe cut-off pump valve), thereby enabling the slight wear to be compensated for by adjusting the threaded rod (S2) on the S-bend pipe (S) to achieve precision once again between the tungsten steel ring (S1) of the S-bend pipe (S) as well as the tungsten steel rings (11) of the pump body (10) and thereby restoring pump efficiency.

In summation of the foregoing description, the invention herein improves the pump valve structure of existent concrete mixture pumping trucks that are adversely affected by frictional wear, structural complexity, and difficult disassembly, expensive manufacturing costs and the impossibility of adjustment to compensate for excess clearances and other related shortcomings and, therefore, the invention herein utilizes a modular and components of simple shape to offer a simplified pump valve structure that enables the friction-proofing to meet actual requirements and a breakdown into the light and the heavy aspects which not only achieves a lowering of manufacturing costs but, furthermore, greatly increases the usable degree of frictional wear to prolong the service life and, meanwhile, can be readjusted in precision increments through the threaded rod on the S-bend pipe to effectively compensate for the excess clearance between components due to frictional wear and, therefore, the invention herein complies with new patent application requirements and is hereby lawfully submitted in application for the granting of the commensurate patent rights.

What is claimed is:

1. A pump valve assembly for a positive displacement pump having a pair of piston containing cylinder bores opening to a front wall for conveying a concrete mixture from a feed chamber to a delivery tube, the valve assembly designed for easy service comprising:

a valve body having two valve body holes therethrough and mountable to said front wall, the holes in fluid communication with said cylinder bores of said positive displacement pump;

two valve body wear rings;

a front connecting piece;

the two valve body wear rings each in fluid communication with a respective valve body hole and together retained in the valve body by the front connecting piece;

an S-bend tube having an input port, an output port and an axis of rotation about said output port, said S-bend tube output port journaled in a rear wall;

a delivery tube mounted in said rear wall and in fluid communication with said S-bend tube;

a rod having axially aligned splines, a threaded end, and an opposite end integral with said S-bend tube;

said rod journaled in said front wall;

a crank slidingly attached to said splines for driving the rod and said S-bend tube in reciprocating rotary motion;

a nut threadedly attached to the rod and holding said crank in compression with one side of said front wall and reactively pulling said S-bend tube against an opposite side of said front wall;

said S-bend tube establishing fluid communication between said valve body wear rings and said delivery tube, said S-bend tube being pivotable about an axis in common with said rod axis and said delivery tube to cause a translational movement of said input port across said valve body between two operative positions, in each operative position said input port being in register with either one of said valve body wear rings;

an S-bend wear ring, engaged with the input port of the S-bend tube;

whereby in use, said compression of the valve assembly against the pump is achieved solely at the first wall, with the journaled delivery tube at the rear wall providing only alignment and support, such a single-mount configuration thereby enabling rapid disassembly and access to the valve body wear rings and the S-bend wear ring.

2. The pump valve assembly of claim 1, wherein the valve body wear rings and the S-bend wear ring are made of tungsten steel.

* * * * *